United States Patent [19]

Hutson

[11] 3,946,864

[45] Mar. 30, 1976

[54] SEMICONDUCTOR CHIP PACKAGE

[76] Inventor: Jearld L. Hutson, 2019 W. Valley View Lane, Dallas, Tex. 75234

[22] Filed: July 1, 1974

[21] Appl. No.: 484,671

[52] U.S. Cl. ..... 206/332; 206/445; 206/515; 220/23.8

[51] Int. Cl.[2] ..... B65D 85/30

[58] Field of Search ..... 317/101 CM; 206/332, 329, 206/538, 539, 445, 471, 504, 515, 418, 333; 220/23.6, 23.8

[56] References Cited

UNITED STATES PATENTS

| | | | |
|---|---|---|---|
| 1,671,285 | 5/1928 | Hanna | 206/445 |
| 1,758,568 | 5/1930 | Finley | 229/39 B |
| 2,902,628 | 9/1959 | Leno | 317/101 CM |
| 3,103,774 | 9/1963 | Wall | 206/445 |
| 3,385,426 | 5/1968 | May et al. | 206/329 |
| 3,469,686 | 9/1969 | Gutsche et al. | 206/332 |
| 3,650,430 | 3/1972 | Siegmar et al. | 206/332 |
| 3,661,253 | 5/1972 | Cronkhite | 206/332 |

*Primary Examiner*—William Price
*Assistant Examiner*—Bruce H. Bernstein
*Attorney, Agent, or Firm*—Richards, Harris & Medlock

[57] ABSTRACT

The specification discloses a package for a plurality of semiconductor chips which enables both visual and physical inspection and testing of the chips prior to the opening of the package. The package includes first and second transparent plastic sheets each having an array of depressions formed therein. The sheets are adjacently disposed and the depressions are mated and nested with one another in order to form a plurality of discrete compartments for containing the semiconductor chips. The sheets are attached about the peripheries to form a package for transmitting the chips. Apertures are formed through each of the plastic sheets in the region of each of the compartments, the apertures being smaller than the chips to constrain the chips within the compartments while allowing access to the chips through the apertures to enable physical testing of electrical characteristics of the chips. Due to the transparent nature of the plastic sheets, the chips may also be visually inspected prior to opening of the package.

2 Claims, 4 Drawing Figures

SEMICONDUCTOR CHIP PACKAGE

FIELD OF THE INVENTION

This invention relates to semiconductor devices, and more particularly relates to packages for semiconductor chips.

THE PRIOR ART

In the manufacture of semiconductor devices, often one manufacturer fabricates semiconductor chips and transports the chips to a second manufacturer which then adds the leads and packaging to form complete semiconductor devices. Plastic packages have been heretofore developed for shipping a plurality of the semiconductor chips. However, in order to perform quality control checks on the chips such as testing by electrical probes, the chips have heretofore been required to be removed from the package. A problem has thus long existed in such an arrangement as to where the line of responsibility for chip quality ends for the first manufacturer. For example, disputes as to responsibility have arisen in cases when the semiconductor chips may have been damaged during such inspection and testing by the second manufacturer.

A need has thus arisen for a package for semiconductor chips which protects the semiconductor chips during shipment, but which allows both visual inspection and physical testing of the semiconductor chips prior to removal from the package. With such a package, after the chips have been tested and removed from the package, the chips may then be deemed to have been accepted by the second manufacturer and the line of responsibility is then clearly defined.

SUMMARY OF THE INVENTION

In accordance with the present invention, a package is provided for semiconductor chips which enables the semiconductor chips to be visually inspected and physically tested while still in the shipping package. When the chips are removed from the package, the chips are deemed to be acceptable.

In accordance with the present invention, a package for a plurality of semiconductor devices is constructed from transparent material and provided with a plurality of compartments each dimensioned to contain a semiconductor device. Structure defines apertures in each of the compartments which are smaller than the semiconductor devices to prevent removal of the devices while allowing access to portions of the devices from the exterior of the package.

In accordance with a more specific aspect of the invention, a package for a plurality of semiconductor chips includes first and second transparent plastic sheets each having an array of depressions formed therein. The sheets are adjacently disposed and the depressions mated and nested with one another to form a plurality of discrete compartments dimensioned to contain the semiconductor chips. The sheets are then sealed about the peripheries thereof. Structure defines apertures through each of the plastic sheets in the region of each of the compartments. The apertures are smaller than the chips to constrain the chips within the compartments, while allowing access to the chips through the apertures for testing.

In accordance with another aspect of the invention, a method of packaging semiconductor chips includes depositing one of the chips in each of a plurality of depressed regions in a first transparent plastic sheet. A second transparent plastic sheet is oriented relative to the first plastic sheet, the second sheet having depressed regions which are mated with the depressed regions of the first sheet to form compartments for containing the chips. The first and second sheets are then attached. An electrical probe may then be inserted through the apertures in the compartments to test electrical characteristics of the chips.

DESCRIPTION OF THE DRAWINGS

For a more complete description of the presnet invention and for further objects and advantages thereof, reference is now made to the following description taken in conjunction with the accompanying Drawings, in which.

DESCRIPTION OF THE PREFERRED EMBODIMENT

Figure 1:
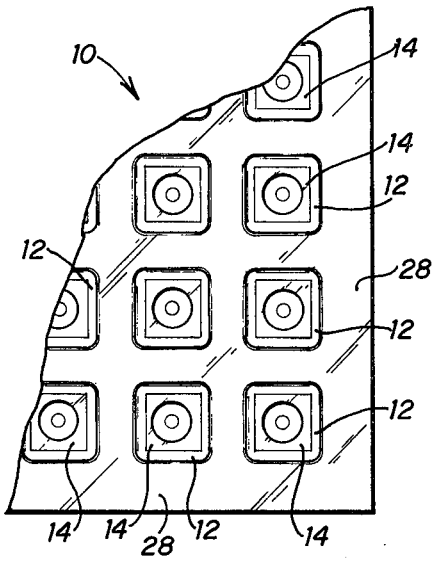
FIG. 1 is a top view, partially broken away, of a package for a plurality of semiconductor chips.

Referring to FIG. 1, the package according to the invention is designated generally by the numeral 10. The package 10 includes a plurality of compartments 12 arranged in a symmetrical array. Each of the compartments 12 is dimensioned to contain a rectangular semiconductor device 14 which may comprise any type of semiconductor device. In particular, the package is useful for accommodating a plurality of semiconductor chips comprised of alternating layers of opposite semiconductor conductivity types. The chips are typically shipped ready for metallization and packaging to form silicon controlled rectifiers, triacs and the like. While only a portion of the package 10 is illustrated in FIG. 1, typically the package will contain 100 compartments 12 for shipping 100 of the semiconductor devices 14.

Figure 2:
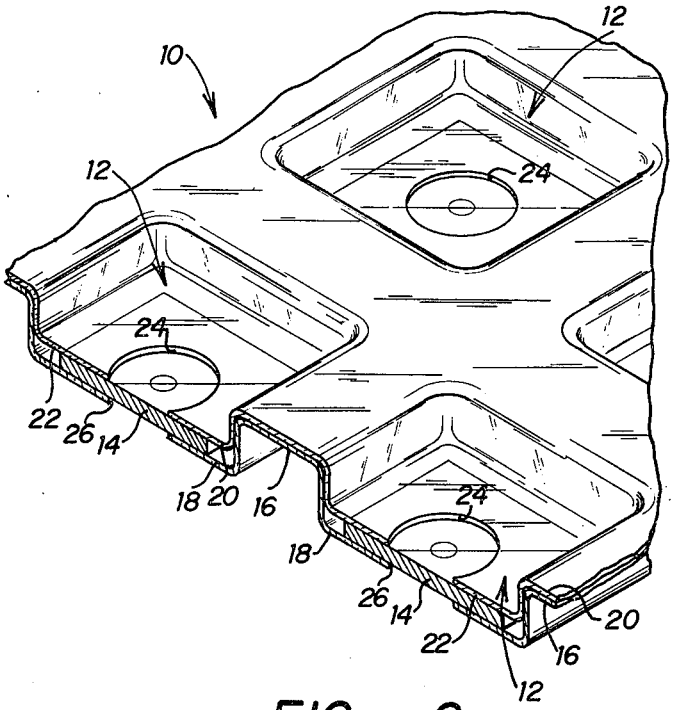
FIG. 2 is a perspective view of a portion of the package shown in FIG. 1.

Referring to FIG. 2, the package 10 is comprised of a first transparent plastic sheet 16 having a plurality of rectangular depressions 18 formed therein. A second transparent plastic sheet 20 also has an array of rectangular depressions 22 formed therein.

The semiconductor chips 14 are placed in the depressions 18 in sheet 16. The depressions 18 are dimensioned to be slightly larger than the semiconductor chips 14 to be transported. The second sheet 20 is then disposed adjacent sheet 16 and the depressions 22 are mated and nested with the depressions 18 as illustrated in FIG. 2. The mating depressions form the array of compartments 12 in order to contain the chips 14 for shipment. The transparent plastic sheets 16 and 20 may be formed from any suitable type of thin plastic material. The depressions 18 and 22 may be formed in the plastic sheets by any conventional process such as vacuum forming or the like.

After the chips have been inserted into the compartments, the package is sealed about the outer periphery or margin 28, as shown in FIG. 1, by heat sealing, stapling or the like.

Since the plastic sheets 16 and 20 are transparent, the semiconductor devices 14 may be visually inspected through the sheets such that any obvious defects in the chips 14 may be determined without removing the chips 14 from the package. Any defective chips may then be marked prior to removal of the chips from the package. In this way, a device manufacturer will be able to return the defective chips in the unopened package to the chip manufacturer for replacement or credit, without any question being raised as to the responsibility for the defects.

A very important aspect of the present invention is the provision of apertures 24 through sheets 20 and apertures 26 formed through sheet 16. In the preferred embodiment, apertures 24 and 26 are circular and are smaller than the chips 14. Apertures 24 and 26 are formed generally in the center of the depressions 18 and 22 such that the center regions of the chips 14 are exposed. It will of course be understood that the circular shape of the apertures 24 and 26 could be modified.

Figure 3:
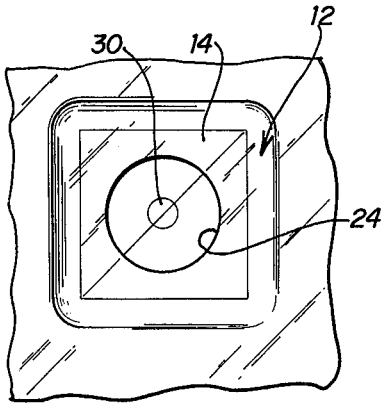
FIG. 3 is an enlarged top view of one of the compartments shown in FIG. 1.
Figure 4:
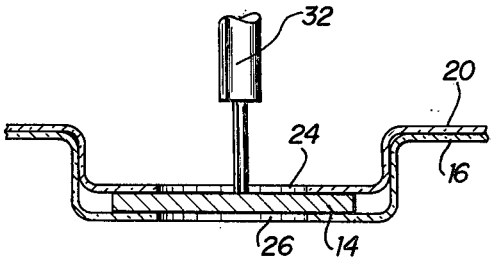
FIG. 4 is a sectional view of the compartments shown in FIG. 3 illustrating the use of an electrical test probe through an aperture in the package.

Referring to FIGS. 3 and 4, the purpose of the apertures 24 and 26 will become more apparent. The device shown in FIGS. 3 and 4 includes a gate region 30 which is exposed by virtue of the positioning of the aperture 24. Thus, an electrical probe 32 may be disposed through the aperture 24 in order to perform electrical testing of various electrical characteristics of the gate regions 30 of the chip 14. Similarly, the probe 13 may be disposed through the aperture 26 in order to check electrical characteristics of the underside of the chip 14. Due to the symmetrical array of the compartments 12 and the apertures 24 and 26, the probing may be accomplished with an automatic probing system.

It will thus be seen that the present package will provide protection to a plurality of semiconductor chips during shipment. Upon receipt, the chips may be visually inspected for defects due to the transparent nature of the package. In addition, the semiconductor chips may be electrically tested for all desired parameters to insure that the devices are defect free. The chips are glass passivated and are thus not harmed due to the exposure to the atmosphere because of the apertures 24 and 26.

If the chips within the package pass all quality control visual inspections and electrical tests, the package may then be opened by breaking the seal about the periphery thereof. The devices may then be removed and utilized in the construction of complete semiconductor devices. If, however, one or more of the chips are deemed to have defects, the defective chips may be marked and the entire package sent back unopened to the chip manufacturer. The present package thus protects both the chip manufacturer and the device manufacturer by providing a clear line of demarcation of responsibility for chip defects.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A package for a plurality of semiconductor chips comprising:

a plurality of semiconductor chips each having opposed gate regions, first and second transparent plastic sheets each having an array of depressions formed therein, said sheets being adjacently disposed and said depressions of said first sheet nested with said depressions of said second sheet to form a plurality of discrete compartments between said sheets and spaced from the plane of said sheets, each of said compartments being dimensioned to contain one of said semiconductor chips and to allow visual inspection of said chips, means for attaching said sheets about the peripheries thereof with a permanent bond, structure defining apertures through each of said plastic sheets in the region of each of said compartments, said apertures being aligned and centrally disposed relative to said depressions and being oriented adjacent said gate regions to enable electrical testing of said chips, said apertures being smaller than said chips to constrain said chips within said compartments while allowing access to said chips through said apertures to enable electrical testing of the chips.

2. The package of claim 1 wherein said depressions and said chips are rectangular.

* * * * *